US008057273B2

(12) United States Patent
Ito et al.

(10) Patent No.: US 8,057,273 B2
(45) Date of Patent: Nov. 15, 2011

(54) METHOD FOR PRODUCING AIRTIGHT CONTAINER

(75) Inventors: Nobuhiro Ito, Yamato (JP); Yasuo Ohashi, Hadano (JP); Kosuke Kurachi, Kawasaki (JP); Masahiro Tagawa, Isehara (JP)

(73) Assignee: Canon Kabushiki Kaisha, Tokyo (JP)

( * ) Notice: Subject to any disclaimer, the term of this patent is extended or adjusted under 35 U.S.C. 154(b) by 27 days.

(21) Appl. No.: 12/609,943

(22) Filed: Oct. 30, 2009

(65) Prior Publication Data

US 2010/0112890 A1 May 6, 2010

(30) Foreign Application Priority Data

Nov. 4, 2008 (JP) ..... 2008-283125

(51) Int. Cl.
*H01J 9/26* (2006.01)
*H01J 9/32* (2006.01)

(52) U.S. Cl. ..... 445/25; 445/24; 445/43; 29/898.11; 65/32.2; 65/33.2; 65/33.5

(58) Field of Classification Search ..... 445/24–25, 445/43; 65/33.2, 33.5, 32.2, 34; 29/88.3, 29/898.11, 888.3; 313/495–497, 306, 309–310, 313/346, 351, 355
See application file for complete search history.

(56) References Cited

U.S. PATENT DOCUMENTS

| | | | | |
|---|---|---|---|---|
| 6,249,329 | B1 * | 6/2001 | Dabral et al. | 349/73 |
| 6,416,375 | B1 * | 7/2002 | Cho et al. | 445/25 |
| 6,722,937 | B1 | 4/2004 | Ludwig | |
| 2003/0143914 | A1 * | 7/2003 | Yoon | 445/24 |
| 2007/0164674 | A1 * | 7/2007 | Hori | 313/512 |
| 2010/0117525 | A1 * | 5/2010 | Warashina et al. | 313/504 |

FOREIGN PATENT DOCUMENTS

| | | | | |
|---|---|---|---|---|
| EP | 0609815 | A1 | | 8/1994 |
| EP | 0978489 | A2 | | 2/2000 |
| EP | 1126496 | A2 | | 8/2001 |
| JP | 01-158794 | A | | 6/1989 |
| JP | 01158794 | A | * | 6/1989 |
| JP | 7-094102 | A | | 4/1995 |
| JP | 2000-149783 | A | | 5/2000 |
| JP | 2000-313630 | A | | 11/2000 |
| JP | 2001-229828 | A | | 8/2001 |
| WO | WO 2008120453 | A1 | * | 10/2008 |

* cited by examiner

*Primary Examiner* — Nimeshkumar Patel
*Assistant Examiner* — Jose M Diaz
(74) *Attorney, Agent, or Firm* — Canon U.S.A., Inc., IP Division

(57) ABSTRACT

A method for producing an airtight container includes preparing an assembly having a first substrate and a frame member, the first substrate having an electron-emitting element formed on a first surface thereof, the frame member mounted on the first surface outside an area where the electron-emitting element is formed; forming a temporary assembly having the assembly and a second substrate by bringing the second substrate into contact with the frame member via a joining member such that an inner space is formed; melting the joining member by irradiating the joining member with a laser beam transmitted through the second substrate; and solidifying the melted joining member. The laser beam is applied such that an incident direction at an irradiation position on the joining member does not include components toward the interior of the frame member while the laser beam moves relative to the temporary assembly.

8 Claims, 10 Drawing Sheets

(PRIOR ART)

(Prior Art)

METHOD FOR PRODUCING AIRTIGHT CONTAINER

BACKGROUND OF THE INVENTION

1. Field of the Invention

The present invention relates to methods for producing airtight containers, and in particular, relates to methods for producing vacuum-tight containers including electron-emitting elements thereinside.

2. Description of the Related Art

So-called field-emission displays (FEDs) including cold-cathode electron sources and phosphors capable of cathodoluminescence serving as image-forming members are well known. Vacuum-tight containers applicable to the FEDs need to maintain a constant high vacuum so as to maintain the electron-emission function for a long period of time. In order to maintain the vacuum in the vacuum-tight containers, the containers need to be hermetic. Thus, methods for producing airtight containers with high vacuum-tightness are required.

A method using frit glass as described in Japanese Patent Laid-Open No. 7-94102 (equivalent to European Patent Laid-Open No. 0609815) is well known as an example of a method for producing high-vacuum containers. An electron-source substrate with electron-emitting elements, a front substrate with a phosphor, and a frame member are joined to each other using frit glass, and the frit glass is fired so as to form an airtight container. Subsequently, the container is evacuated to a vacuum via an exhaust pipe connected to the airtight container. Finally, the exhaust pipe is chopped off, and the container is sealed. In this manner, production of a vacuum-tight container is completed.

However, the method described in Japanese Patent Laid-Open No. 7-94102 requires the temperature of the container to rise up to the softening and melting temperature of the frit glass during firing of the frit glass. This causes effects such as sublimation, oxidation, and reduction on electron sources on the electron-source substrate and the like in a marked manner, thereby causing variations in characteristics of the electron-emitting elements.

In order to mitigate the effects caused by the heating, a method in which an airtight container is disposed in a vacuum atmosphere throughout the production thereof, as described in Japanese Patent Laid-Open No. 2001-229828 (equivalent to European Patent Laid-Open No. 1126496), is well known. In this case, effects such as oxidation on electron-emitting elements can be suppressed by using a metal with a low melting point as a joining member. However, when high-definition and large-panel displays are required, there are issues such as accuracy in alignment during a bonding process in a high-temperature vacuum and cycle time for an evacuating process.

To resolve these issues, Japanese Patent Laid-Open No. 2000-149783 describes a sealing and bonding method using local heating by scanning high-density energy beams. This method includes alignment performed in an atmosphere of normal temperature and normal pressure and local heating. Therefore, thermal effects on electron-emitting elements are minimized, and a highly airtight and, at the same time, highly accurately aligned container can be produced at low cost. U.S. Pat. No. 6,722,937 and Japanese Patent Laid-Open No. 2000-313630 (equivalent to European Patent Laid-Open No. 0978489) also describe the joining methods using emission of high-density energy beams.

When joining members are softened and melted by scanning laser beams, the scanning speed also needs to be increased so that large-size or low-cost displays are produced.

In this case, energy density of the laser source per unit time needs to be increased. However, some of the laser beams are reflected, and are not directly used for heating of the joining members. In addition, the reflected beams become stray light beams that may exert thermal effects on other members. In particular, when metal is used as a joining member so that more minute joining interfaces are obtained, the thermal effects of the stray light beams during the laser joining process may be enhanced due to the high reflectivity. When airtight containers are applied to FEDs and the like, it is not preferable in view of emission characteristics that the surface shapes and compositions of emitting portions of electron-emitting elements inside the FEDs vary.

SUMMARY OF THE INVENTION

The present invention is directed to a method for producing an airtight container capable of suppressing effects of stray laser beams on electron-emitting portions.

In accordance with a method for producing an airtight container according to an aspect of the present invention, an airtight container including a first substrate having an electron-emitting element disposed on a first surface thereof, a light-transmitting second substrate facing the first substrate, and a frame member interposed between the first substrate and the second substrate, the first substrate, the second substrate, and the frame member forming an inner space in which the electron-emitting element is located is produced. The method includes preparing an assembly having the first substrate and the frame member mounted on the first surface of the first substrate outside an area where the electron-emitting element is formed; forming a temporary assembly having the assembly and the second substrate by bringing the second substrate into contact with the frame member via a joining member; melting the joining member by irradiating the joining member with a laser beam transmitted through the second substrate of the temporary assembly; and solidifying the melted joining member. The laser beam is applied onto the joining member such that an incident direction of the laser beam at an irradiation position on the joining member does not include components toward the interior of the frame member while the laser beam moves relative to the temporary assembly during melting of the joining member.

Further features of the present invention will become apparent from the following description of exemplary embodiments with reference to the attached drawings.

DESCRIPTION OF THE EMBODIMENTS

According to a method for producing an airtight container of the present invention, an airtight container including a first substrate having electron-emitting elements disposed on a first surface thereof, a second substrate facing the first substrate, and a frame member interposed between the first substrate and the second substrate is produced. The first substrate, the second substrate, and the frame member form an inner space in which the electron-emitting elements are located. The method for producing the airtight container of the present invention can also be applied to vacuum fluorescent displays (VFDs). However, aspects of the present invention may also be applied to a method for producing a so-called FED including cold-cathode electron sources serving as electron-emitting elements and a phosphor capable of cathodoluminescence serving as an image-forming member. For one reason, since a joining member may not be entirely softened and melted at one time in accordance with aspects of the present invention, an airtight container can be easily produced while structures other than the joining member are in an atmosphere of normal temperature and normal pressure. This leads to maintenance of accuracy in alignment between a first substrate (electron-source substrate) and a second substrate (phosphor substrate). Moreover, since local heating of only the joining member causes little effects on the electron-emitting elements inside a panel, oxidation of the electron-emitting elements and vaporization and decomposition of elements adhered to the top surfaces of the electron-emitting elements are suppressed, and thermal process degradation of the electron-emitting elements can be suppressed. Exemplary embodiments of the present invention will now be described in detail with reference to FIGS. 1A to 11.

In the exemplary embodiments below, terms "first joining member" and "second joining member" will be used in relation to joining of a frame member and substrates (a first substrate and a second substrate). Herein, the first joining member refers to a joining member used for joining an assembly having a first (or second) substrate and a frame member to a second (or first) substrate. The second joining member refers to a joining member used for joining the substrate included in the assembly to the frame member. In other words, an airtight container is formed by joining the assembly to the second (or first) substrate, and the first joining member is used for joining the assembly to the second (or first) substrate. The assembly serving as a part of the airtight container is formed by joining the first (or second) substrate to the frame member, and the second joining member is used for joining the first (or second) substrate to the frame member.

A first exemplary embodiment of the present invention will now be described with reference to FIGS. 1A to 6B.

Figure 1A:
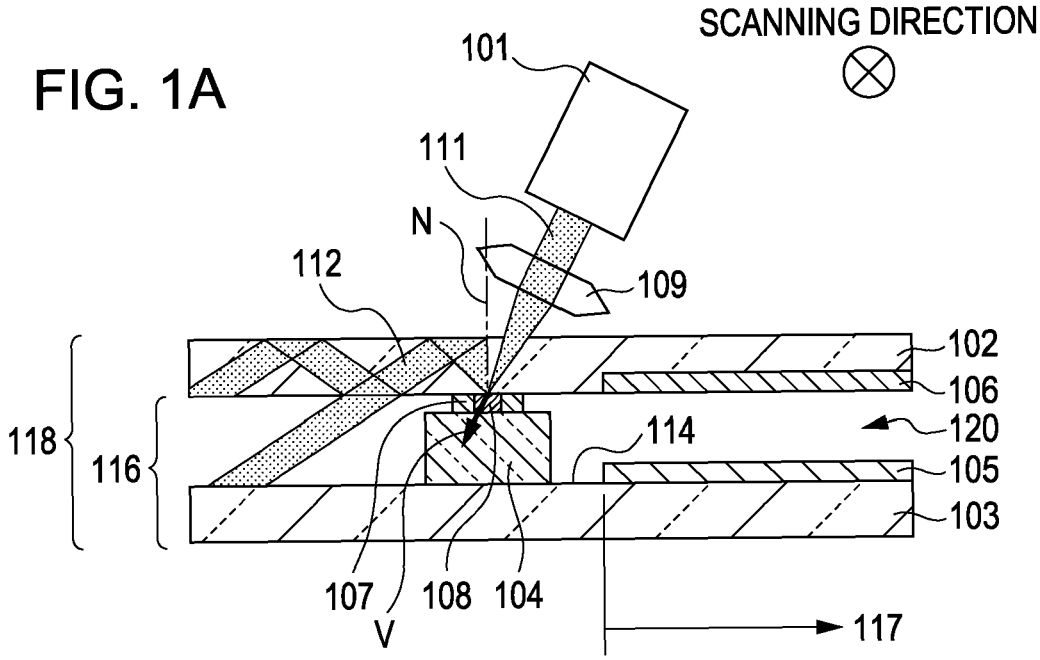
FIGS. 1A and 1B are conceptual views illustrating a method for producing an airtight container according to a first exemplary embodiment of the present invention.
Figure 1B:
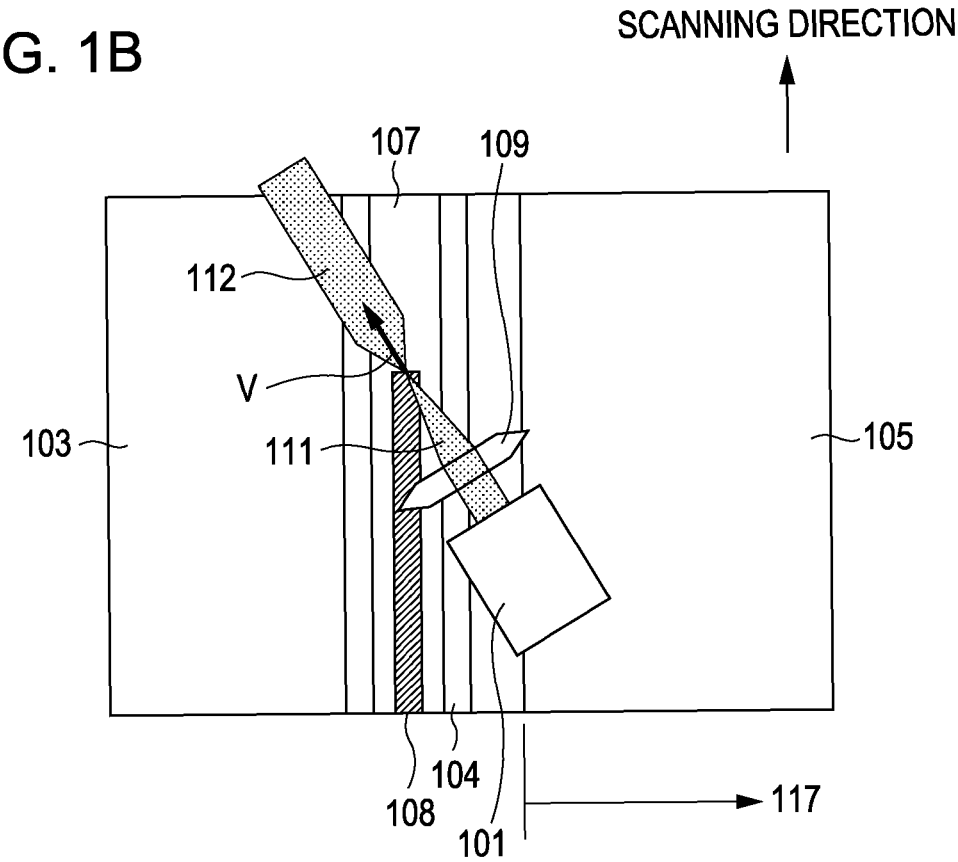
Figure 2:
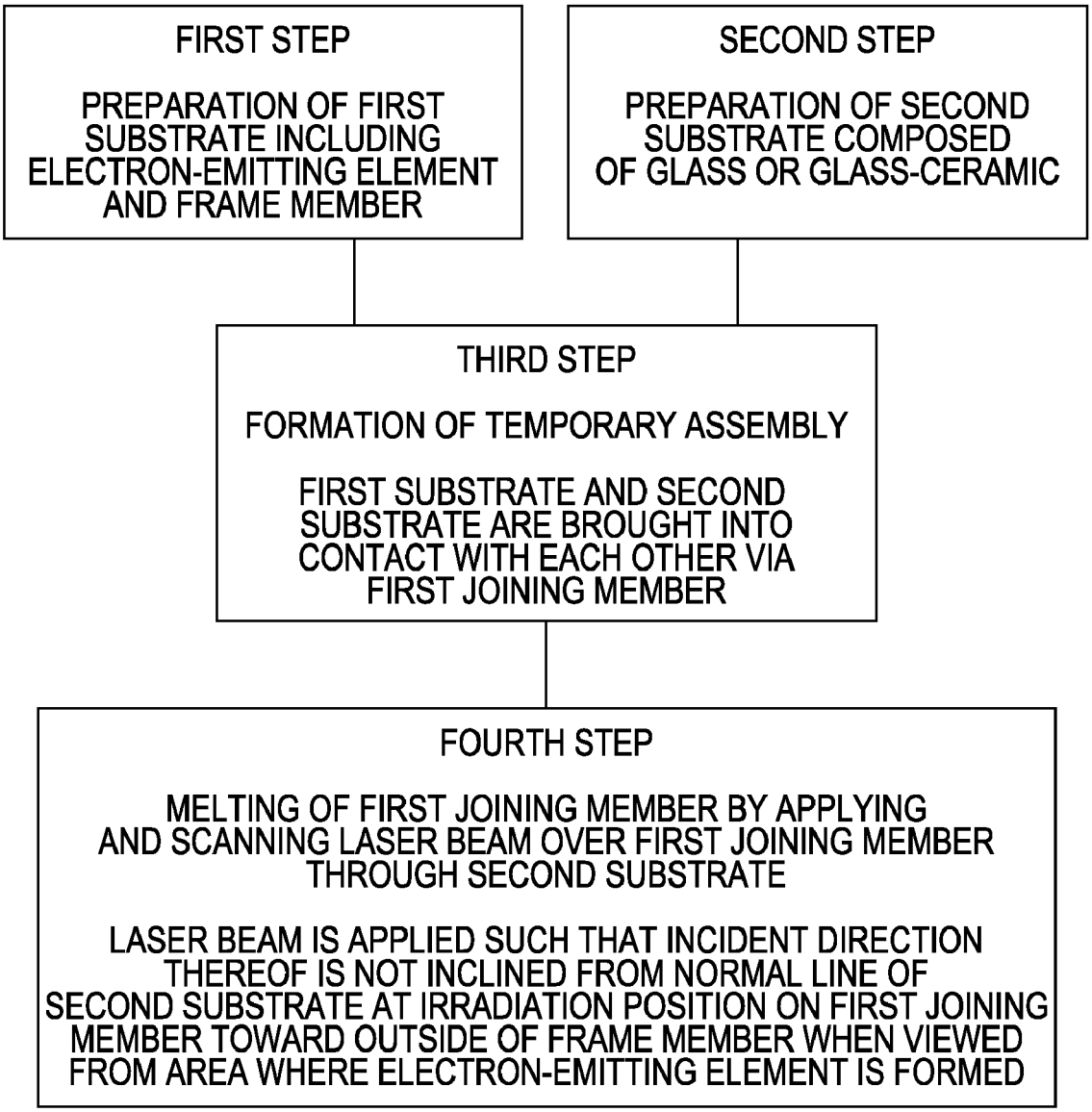
FIG. 2 is a flow chart illustrating the method for producing the airtight container according to the first exemplary embodiment of the present invention.
Figure 3:
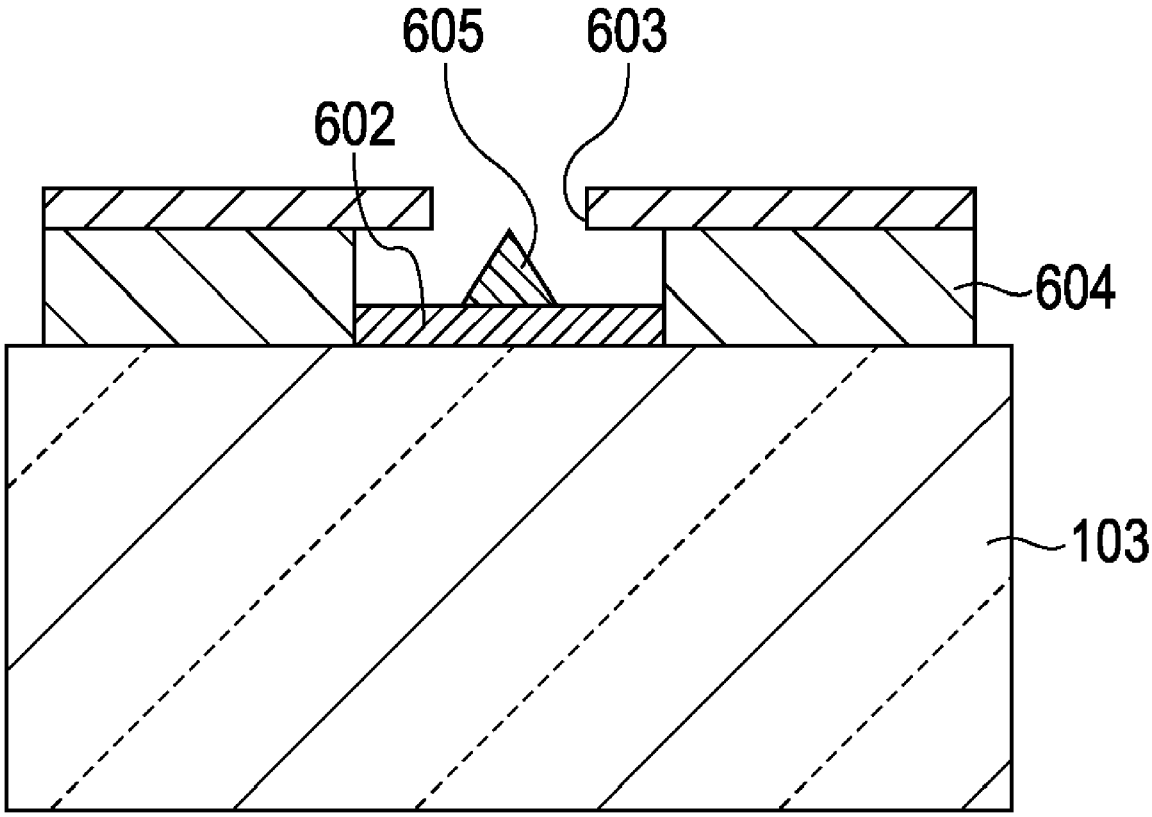
FIG. 3 is a cross-sectional view illustrating an example electron-emitting element applicable to the airtight container of the present invention.

FIGS. 1A and 1B are a cross-sectional view and a top view, respectively, illustrating a concept of a method for producing an airtight container according to the first exemplary embodiment of the present invention. FIG. 2 is a flow chart illustrating the method for producing the airtight container according to the first exemplary embodiment of the present invention.

In a first step, an assembly 116 constituted by a first substrate 103, having electron-emitting elements 105 formed on a first surface 114 thereof, and a frame member 104 is prepared. The frame member 104 is mounted on the first surface 114 of the first substrate 103 outside the area in which the electron-emitting elements 105 are formed. The materials of the first substrate 103 and the frame member 104 can be selected with consideration of the heat resistance and the low degassing property in view of the ultimate vacuum of the vacuum-tight container and with consideration of matching of coefficients of linear expansion between the first substrate 103 and a second substrate 102 and between the frame member 104 and the second substrate 102 in view of structural stability as an airtight container. The first substrate 103 and the frame member 104 may be composed of inorganic transparent materials such as glass or glass-ceramic, and may even be composed of high-strain-point glass such as PD200 available from Asahi Glass Company Ltd. in view of the heat resistance. The first substrate 103 and the frame member 104 may be composed of the same material as the second substrate 102 in view of matching of the coefficients of linear expansion between the first substrate 103 and the second substrate 102 and between the frame member 104 and the second substrate 102.

The electron-emitting elements 105 are formed on the first substrate 103. The electron-emitting elements 105 are connected to a wiring structure (not shown) on the first substrate 103 so that the amount of electron emission can be controlled in accordance with electrical signals from an external circuit. When a display to be produced uses cathodoluminescence of a phosphor, the display is impulse-driven. Therefore, a matrix wiring with a simple structure can be connected to the electron-emitting elements 105. Although the electron-emitting elements 105 can be of the hot-cathode type or of the cold-cathode type, cold-cathode electron sources may be provided in view of suppression of power consumption and color reproducibility. Examples of cold-cathode electron sources to which the production method of the present invention is applicable include those of the Spindt type shown in FIG. 3, the metal-insulator-metal (MIM) type, the surface conduction emitter (SCE) type shown in FIG. 4A, and the carbon nanotube type shown in FIG. 4B. Since the interior of the airtight container, in particular, the electron-emitting elements are protected from laser thermal effects in this exemplary embodiment as described below, thermal damage to the surfaces of the electron-emitting elements, which are important to electron-emission characteristics, can be suppressed. Therefore, an electron-beam display with uniform characteristics and with less process degradation can be provided by applying cold-cathode electron sources.

In a second step, the second substrate 102 composed of glass or glass-ceramic is prepared. A phosphor 106 is formed on the second substrate 102. In this exemplary embodiment, the second substrate 102 may be composed of a light-transmitting material for the purpose of using light emitted from the phosphor 106 formed on the inner surface of the airtight container and of irradiating a first joining member 107 with a laser beam 111 emitted from a laser source 101 and transmitted through the second substrate 102. The potential of the phosphor 106 is defined using an electrode so that cathodoluminescence is generated by impact of electrons emitted from the electron-emitting elements 105. P22 phosphor, capable of emitting light with high color purity when a positive potential difference of more than or equal to several kilovolts is applied to the electron-emitting elements 105, can be used for the phosphor 106.

In a third step, a temporary assembly 118 constituted by the assembly 116 and the second substrate 102 is formed by bringing the second substrate 102 into contact with the frame member 104 via the first joining member 107. The assembly 116 and the second substrate 102 form the temporary assembly 118 having an inner space 120 formed thereinside. The first substrate 103, the frame member 104, the first joining member 107, and the second substrate 102 can be brought into contact with each other using a clamping jig (not shown). The first joining member 107 can be composed of a material with a high reflectivity such as metal. When the first joining member 107 is composed of metal, minute and uniform airtight joining can be achieved, thereby resulting in a vacuum-tight container with high-quality electron-emitting elements. Since the interior of the airtight container, in particular, the electron-emitting elements are protected from laser thermal effects in this exemplary embodiment as described below, thermal damage to the surfaces of the electron-emitting elements, which are important to electron-emission characteristics, can be suppressed even when a metal with a high reflectivity to laser light is used as a joining member.

In a fourth step, the first joining member 107 is irradiated with the laser beam transmitted through the second substrate 102 of the temporary assembly 118 so as to be melted. Subsequently, the melted first joining member 107 is solidified. During melting of the first joining member 107, the laser beam is applied onto the first joining member while moving relative to the temporary assembly 118. The fourth step will now be described in detail.

As shown in FIG. 1A, the laser source 101 and an optical system 109 are disposed such that the optical axes thereof are not parallel to a normal line N of the second substrate 102. In this state, the laser beam is scanned in a direction parallel to the first joining member 107 such that the laser beam moves relative to the temporary assembly 118. At this moment, the laser beam is applied onto the first joining member such that the incident direction (shown by a vector V) at the irradiation position on the first joining member 107 does not include components toward the interior of the frame member 104. In other words, the vector V in a plane parallel to the second substrate second substrate 102 may include only the component parallel to the frame member 104 or those toward the outside of the frame member. Since the laser beam may not include components toward the interior of the frame member 104, the laser beam can be obliquely applied onto the first joining member in the direction parallel to the first joining member 107. The laser beam may be applied onto the first joining member obliquely to the normal line N of the second substrate 102. With this irradiation condition, the melted area of the first joining member 107 is gradually expanded by laser scanning, and the area in which the electron-emitting elements 105 are formed is continuously closed by a first joining area 108. In this manner, the airtight joining is completed.

Subsequently, the container is evacuated to a vacuum. The evacuation method is not limited, and, for example, an opening formed in the first substrate 103, the frame member 104, or the second substrate 102 in advance communicating with the outside of the container can be used. Getters can be used for the evacuation at the same time. The opening can be sealed by any method.

The scanning of the laser source 101 only needs to have a relative velocity to the temporary assembly 118 serving as an object to be irradiated, and either or both of the laser source 101 and the temporary assembly 118 can move. For the purpose of reducing the production cycle time, additional laser source 101 can be provided. Furthermore, corners of a peripheral portion of the first substrate 103 can be continuously scanned. For the purpose of relieving the thermal stress on the object to be irradiated, an auxiliary light source and a processing light source can be combined, and the shaped beams can be simultaneously scanned. In this case, only the optical axis of the laser beam 111 of the processing light source needs to be inclined with respect to the temporary assembly 118. The laser source can be of the continuous irradiation type, or can be pulse-driven using a Q-switch.

Next, a first reason for inclining the optical axis of the laser beam 111 as described above will be described with reference to FIGS. 3 to 5. The electron-emission characteristics of the above-described cold-cathode electron sources are determined by the shape and the physical properties of the surface of the electron sources at the electron-emitting points. In the case of an electron-emitting element of the Spindt type shown in FIG. 3, a cathode electrode 602 and a dielectric layer 604 are formed on the first substrate 103, and a cone 605 is formed on the cathode electrode 602. A gate-electrode opening 603 is formed above the cone 605. The electron-emission characteristics of the electron-emitting element with the above-described structure vary when the surface composition of the cone 605, the tip shape of the cone 605, or the distance between the tip of the cone 605 and the gate-electrode opening 603 vary depending on the positions. The dimensions of the tip of the cone 605 need to be controlled from the order of nanometers to the order of the size of an atomic layer for the composition of the top surface and on the order of several nanometers for the curvature of the extreme tip. The dimensions of this extremely minute area also need to be controlled during production processes after the process during which the electron-emitting element is formed on the substrate. When the present invention is applied to a FED, it may be necessary that the tip of the electron-emitting element not be damaged during processing and that variations in the electron-emission characteristics not occur in view of uniformity in image quality.

Figure 4A:
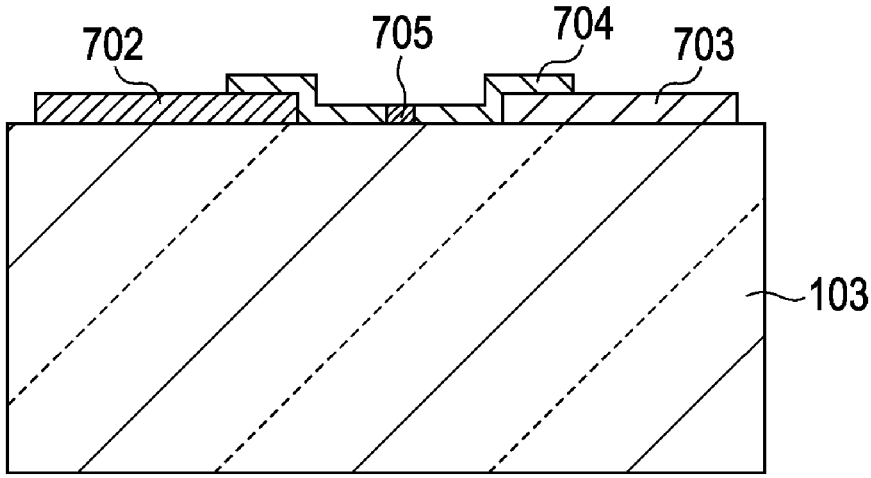
FIGS. 4A and 4B are cross-sectional views illustrating example electron-emitting elements applicable to the airtight container of the present invention.
Figure 4B:
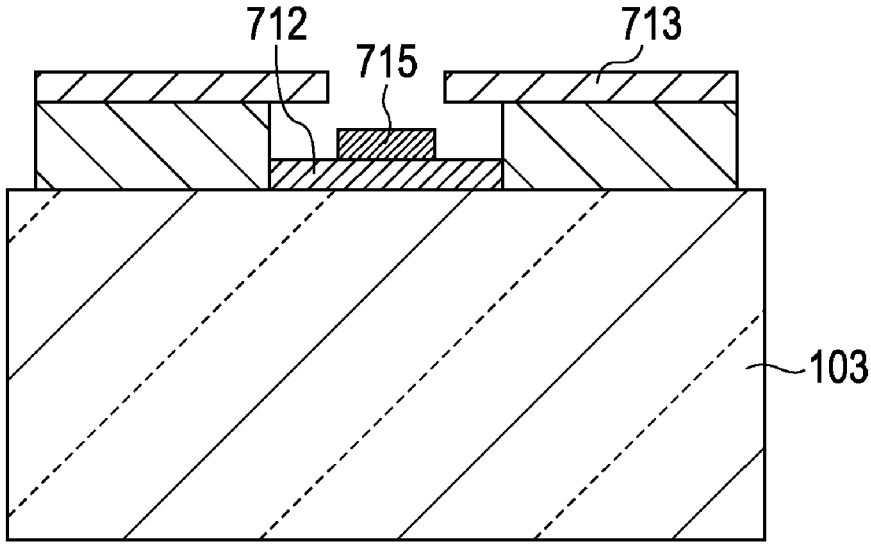

The same applies to the case when the electron-emitting elements of the SCE type shown in FIG. 4A or those of the carbon nanotube type shown in FIG. 4B are applied to the electron-emitting elements on the first substrate. In the case of an electron-emitting element of the SCE type, the shape and the physical properties of the surface of an electron-emitting portion 705 and the positions of a cathode electrode 702, a gate electrode 703, and a semiconductor film 704 may need to be controlled on the order of nanometers in view of suppressing process degradation of the electron-emission characteristics. Similarly, in the case of the carbon nanotube type, the shape and the physical properties of the surface of an electron-emitting portion 715 and the positions of a cathode electrode 712 and a gate electrode 713 may need to be controlled on the order of nanometers.

Figure 5:
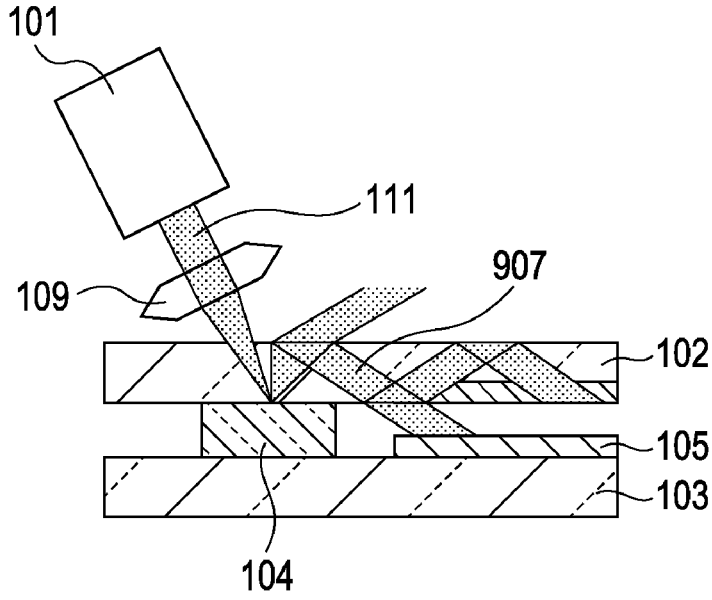
FIG. 5 is a cross-sectional view illustrating a first issue to be solved by the present invention.

Problems when a known production method is applied will now be described with reference to FIG. 5. The first joining member is not illustrated in FIG. 5. As shown in FIG. 5, when the laser beam is obliquely incident on the first joining member so as to be directed to the inner surface of the panel, the reflected beam that is not used for melting the first joining member becomes a stray light beam, and may reach the inner space of the airtight container. For example, part of the laser beam 111 emitted from the laser source 101 becomes a reflected beam 907 at the position of the first joining member (not shown). The reflected beam 907 is reflected inside the second substrate 102, and part thereof reaches and heats the electron-emitting element 105 on the first substrate 103 in some cases.

When a metal is used as the first joining member, an excellent air-tightness can be expected. However, the light reflectivity is high, and the reflected beam is not easily attenuated compared with the case when frit glass is used. In particular, a metal such as aluminum disposed on the inner surface of the phosphor adjacent to the vacuum (referred to as a metal back) in a FED may present problems. The reflected beam 907 is a reflected beam of the laser beam 111 with a high energy density capable of melting metal such as aluminum, and in addition, the emissivity thereof is low in the visible region to the infrared region, which are general wavelength regions of the processing laser beam. That is, the reflectivity of the reflected beam is high. Therefore, when the reflected beam reaches electron-emitting portions, the reflected beam exerts non-negligible effects in some cases on the shapes and the surface compositions of the electron-emitting portions existing in an area of several nanometers to the size of an atomic layer. The top surfaces of the tips are not composed of only diamond or a metal with a low work function, but are composed of relatively unstable compositions such as graphite (sp2), hydrocarbon, hydrogen, and water. Moreover, the curvatures of the tips on the order of several nanometers are also expected to be affected by the heat.

Therefore, the reflected beam of the laser beam serving as the processing light may need to be controlled. To solve this first problem, the laser beam is applied onto the first joining member such that the incident direction thereof at the irradiation position on the first joining member does not include components toward the interior of the frame member. With this, the interior of the airtight container, in particular, the electron-emitting elements are protected from the thermal effects of the laser, and thermal damage to the surfaces of the electron-emitting elements, which are important to electron-emission characteristics, can be suppressed. Thus, an electron-beam display with uniform characteristics can be provided even when electron-emitting elements with a high electron-emitting efficiency but with less thermal stability are used. As a result, a low-power high-quality electron-beam display can be provided.

Figure 6A:
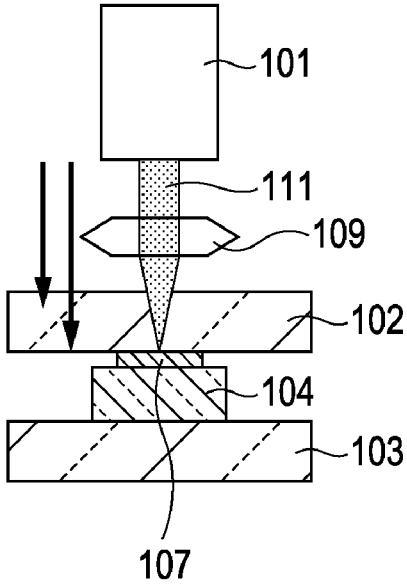
(PRIOR ART) FIG. 6A
FIGS. 6A and 6B are cross-sectional views illustrating a second issue to be solved by the present invention.
Figure 6B:
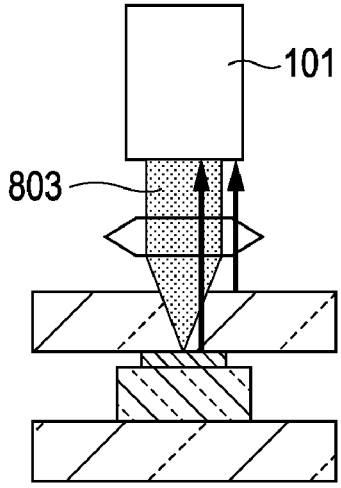
(PRIOR ART) FIG. 6B

A second reason for inclining the optical axis of the laser beam 111 as described above will now be described with reference to FIGS. 6A and 6B. In FIGS. 6A and 6B, the laser source 101 and the optical system 109 are disposed such that the laser beam is perpendicularly incident on an object to be irradiated (see FIG. 6A). With this arrangement, a reflected beam 803 generated at the first joining member 107 and the second substrate 102 returns to the laser source 101 as shown in FIG. 6B, and causes a temperature rise and expansion of the laser source 101 and the optical system 109 that receive the reflected beam. The temperature rise and the expansion may cause problems such as drifts of laser output and optical control errors. Furthermore, the returned light beam 803 affects the control of melting state of the first joining member, and a uniform joining state may not be achieved. Therefore, the laser beam may not be perpendicularly applied onto the first joining member 107 but may be obliquely applied onto the first joining member 107 so that the reflected beam does not return to the laser source 101.

A second exemplary embodiment of the present invention will now be described in detail with reference to FIGS. 7A to 8. This exemplary embodiment is characterized in that the assembly 116 described in the first exemplary embodiment is prepared by using laser irradiation. With this, the electron-emitting elements can be protected, and a high-quality vacuum-tight container and an electron-beam display can be stably provided.

First, in the second exemplary embodiment, the frame member 104 and the first substrate 103 are joined to each other using a light-transmitting pushing plate 202. The pushing plate 202 is temporarily brought into contact with the frame member 104, and is not joined to the frame member 104. The pushing plate 202 is used for joining the frame member 104 and the first substrate 103 to each other using the light-transmitting property and the rigidity thereof. Therefore, it may be that the pushing plate 202 is composed of glass or glass-ceramic.

In a first step, the first substrate 103 having the electron-emitting elements 105 formed on the first surface 114 thereof is prepared.

In a second step, the pushing plate 202 composed of glass or glass-ceramic and the frame member 104 composed of glass or glass-ceramic are prepared.

In a third step, a structure 124 is formed by bringing the first substrate 103 into contact with the frame member 104 via a second joining member 207 and by pushing the frame member 104 by the light-transmitting pushing plate 202 such that the frame member 104 is temporarily fixed to the first substrate 103. More specifically, the first substrate 103 is brought into contact with the frame member 104 via the second joining member 207, and subsequently, the frame member 104 is brought into contact with the pushing plate 202. It may be that the first substrate 103, the second joining member 207, the frame member 104, and the pushing plate 202 are brought into contact with each other using a clamping jig (not shown).

In a fourth step, the second joining member 207 is irradiated with a laser beam 211 transmitted through the pushing plate 202 and the frame member 104 so that the second joining member 207 is melted and a second joining area 208 is formed. The laser beam 211 is applied onto the second joining member so as to be parallel to the second joining member 207 while moving relative to the first substrate 103. Moreover, the laser beam 211 is applied onto the second joining member such that the incident direction at the irradiation position on the second joining member 207 does not include components toward the interior of the frame member 104. With this, the orthogonal projections of the optical axes of the laser beam 211 and a reflected beam 212 to the first surface 114 of the first substrate 103 do not overlap with the electron-emitting elements 105 on the first surface 114. It is desirable that the laser source 101 and the optical system 109 be disposed such that the optical axis of the laser beam 211 is not parallel to the normal line N of the first substrate 103 and the pushing plate 202 as shown in FIG. 7A. With this irradiation condition, the melted area of the second joining member 207 is gradually expanded by laser scanning, and the area in which the electron-emitting elements 105 are formed is continuously closed by the second joining area 208. In this manner, the airtight joining is completed. Subsequently, the melted second joining member 207 is solidified. In this manner, an assembly is prepared.

In a fifth step, the pushing plate 202 is removed from the structure 124, and the frame member 104 and the second substrate 102 are joined to each other. As in the first exemplary embodiment, laser joining is may be provided in view of production cycle time, alignment accuracy, and thermal effects on the electron-emitting elements.

According to this exemplary embodiment, thermal damage to the electron-emitting elements can also be prevented, and the electron-emission characteristics can also be improved. Since the laser source is not affected by the beam reflected from the first substrate and the pushing plate, the laser source is protected from the thermal effects of the reflected beam, and can maintain stable operation.

Figure 9A:
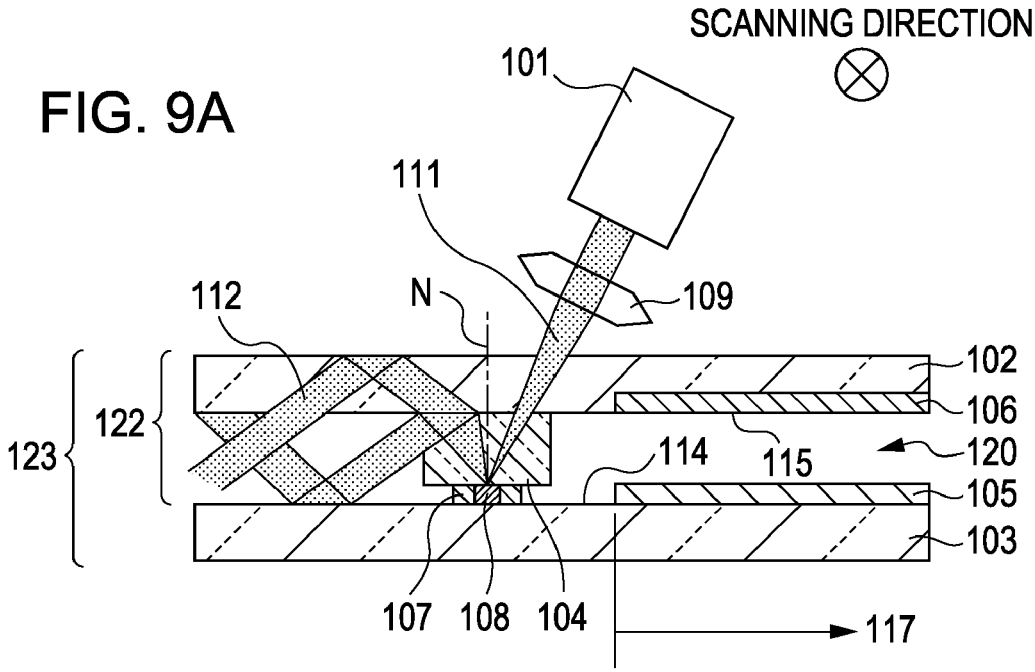
FIGS. 9A and 9B are conceptual views illustrating a method for producing an airtight container according to a third exemplary embodiment of the present invention.
Figure 9B:
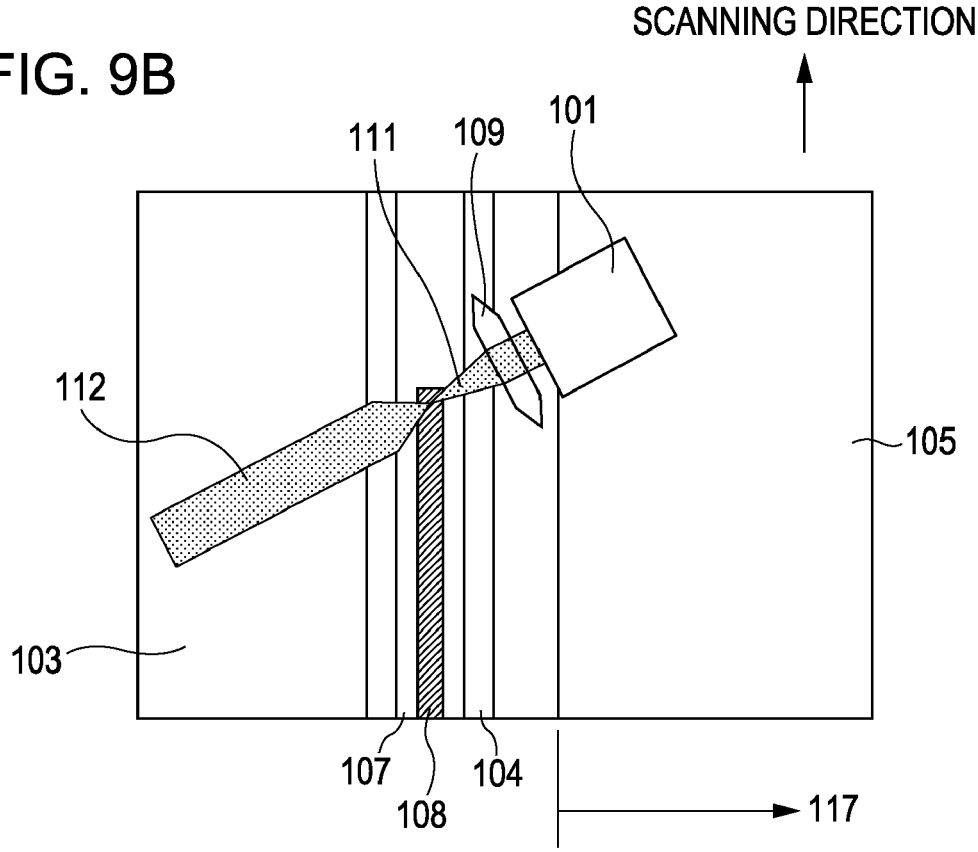
Figure 10:
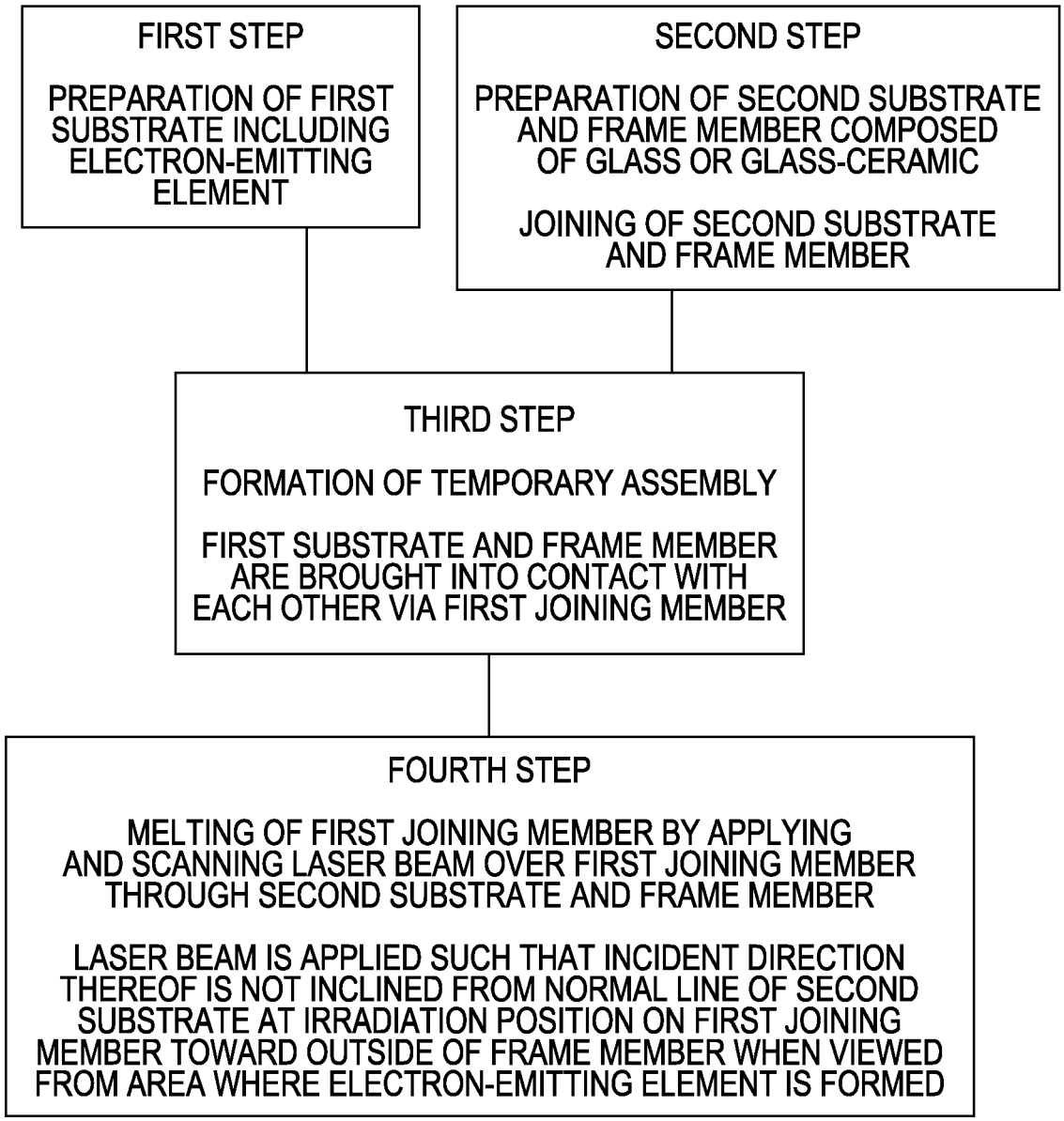
FIG. 10 is a flow chart illustrating the method for producing the airtight container according to the third exemplary embodiment of the present invention.

A third exemplary embodiment of the present invention will now be described in detail with reference to FIGS. 9A to 10. FIGS. 9A and 9B are a cross-sectional view and a top view, respectively, illustrating a concept of a method for producing an airtight container according to the third exemplary embodiment of the present invention. FIG. 10 is a flow chart illustrating the method for producing the airtight container according to the third exemplary embodiment of the present invention.

In a first step, the first substrate 103 including the electron-emitting elements 105 is prepared. The material of the first substrate 103 can be selected with consideration of the heat resistance and the low degassing property in view of the ultimate vacuum of the vacuum-tight container and with consideration of matching of coefficients of linear expansion between the first substrate 103 and the second substrate 102 and between the first substrate 103 and the frame member 104 in view of structural stability as an airtight container. The first substrate 103 may be composed of an inorganic transparent material such as glass or glass-ceramic, and may even be composed of high-strain-point glass such as PD200 available from Asahi Glass Company Ltd. in view of the heat resistance. The first substrate 103 may be composed of the same material as the second substrate 102 and the frame member 104 in view of matching of the coefficients of linear expansion between the first substrate 103 and the second substrate 102 and between the first substrate 103 and the frame member 104. The position of the electron-emitting elements 105 formed on the first substrate 103 is the same as in the first exemplary embodiment.

In a second step, the second substrate 102 composed of glass or glass-ceramic and the frame member 104 composed of glass or glass-ceramic are prepared. The phosphor 106 capable of reproducing two-dimensional images using electrons emitted from the electron-emitting elements 105 is formed on the second substrate 102. Next, an assembly 122 is formed by joining the second substrate 102 and the frame member 104 to each other. The frame member 104 is mounted on a surface 115 of the second substrate 102 facing the first substrate 103 outside an area 117 facing the electron-emitting elements 105. The structure, the material, and the like of the second substrate 102 are the same as those of the second substrate 102 in the first exemplary embodiment. The second substrate 102 and the frame member 104 can be joined to each other by any joining method using any joining member. For example, laser joining can be used as in the first exemplary embodiment, or entire heating using glass frit can be used.

In a third step, a temporary assembly 123 constituted by the assembly 122 and the first substrate 103 having the inner space 120 thereinside is formed by bringing the first substrate 103 into contact with the frame member 104 via the first joining member 107. FIG. 9A shows a part of the temporary assembly 123 in which the frame member 104 is in contact with the peripheral portion of the first substrate 103 including the electron-emitting elements 105 via the first joining member 107. The first substrate 103, the first joining member 107, the frame member 104, and the second substrate 102 can be brought into contact with each other using a clamping jig (not shown).

In a fourth step, the first joining member 107 is irradiated with the laser beam 111 transmitted through the second substrate 102 and the frame member 104 of the temporary assembly 123 so that the first joining member 107 is melted. The laser beam is applied onto the first joining member while moving relative to the temporary assembly 123. The laser beam 111 is applied onto the first joining member such that the incident direction at the irradiation position on the first joining member 107 does not include components toward the interior of the frame member 104. With this, as shown in FIG. 9B, the orthogonal projections of the optical axes of the laser beam 111 and reflected beam 112 to the first surface 114 of the first substrate 103 do not overlap with the electron-emitting elements 105. It is desirable that the laser beam be applied onto the first joining member obliquely to the normal line N of the first substrate. Subsequently, the melted first joining member 107 is solidified.

Specifically, in the fourth step, as shown in FIGS. 9A and 9B, the laser source 101 and the optical system 109 are disposed such that the optical axes thereof are not parallel to the normal line N of the second substrate 102. In this state, the laser beam is scanned in the direction parallel to the first joining member 107 such that the laser beam moves relative to the temporary assembly 123. At this moment, the laser beam 111 is applied onto the first joining member such that the incident direction at the irradiation position on the first joining member 107 does not include components toward the interior of the frame member 104. Since it may be that the laser beam is not incident on the first joining member in a direction outwardly inclined, the laser beam can be obliquely applied onto the first joining member in the direction parallel to the first joining member 107. With this irradiation condition, the melted area of the first joining member 107 is gradually expanded by laser scanning, and the area in which the electron-emitting elements 105 are formed is continuously closed by the first joining area 108. In this manner, the airtight joining is completed.

Figure 11:
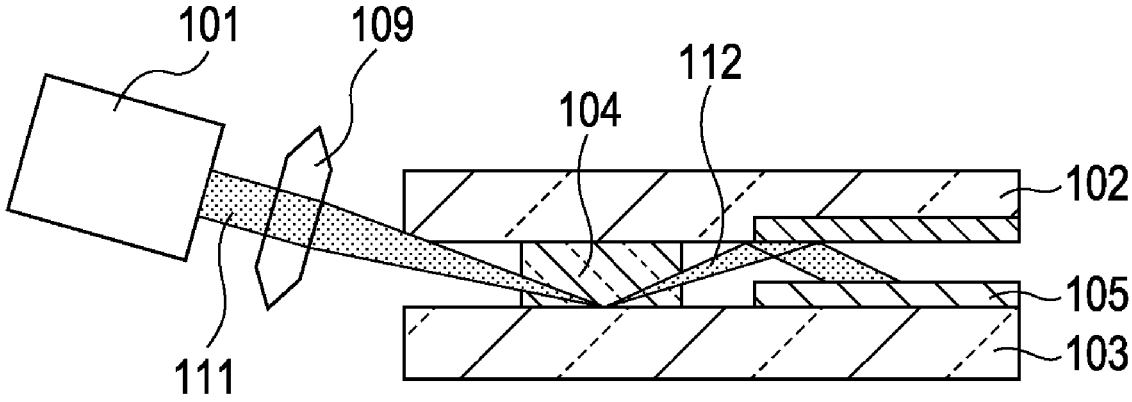
FIG. 11 is a cross-sectional view illustrating the first issue to be solved by the present invention.

In a FED, a metal such as aluminum (referred to as a metal back) is disposed on the inner surface of the phosphor adjacent to the vacuum in some cases. With reference to FIG. 11, the laser source 101 and the optical system 109 are disposed such that the laser beam is focused on the first joining member (not shown) located at the boundary between the first substrate 103 and the frame member 104. In this case, the laser beam is reflected, and becomes a reflected beam 112. The reflected beam 112 passes through the frame member 104, is reflected at the metal back (not shown) on the inner surface of the second substrate 102, and is incident on the electron-emitting elements 105. The intensity of this incident light is high, and may exert detrimental effects on the electron-emitting elements. In this exemplary embodiment, however, incidence of the laser beam as described above can be prevented.

According to this exemplary embodiment, thermal damage to the electron-emitting elements can be prevented, and the electron-emission characteristics can be improved. Since the laser source is not directly affected by the beam reflected from the first substrate 103 and the second substrate 102, the laser source 101 is protected from the thermal effects of the reflected beam, and can maintain stable operation.

EXAMPLES

Specific examples of the present invention will now be described in detail.

Example 1

In this example, a vacuum-tight container was produced by hermetically joining the frame member and the first substrate to each other first using the second exemplary embodiment and subsequently hermetically joining the frame member and the second substrate to each other using the first exemplary embodiment.

First, a first step of producing the first substrate 103 will be described. A substrate (1,000 mm long×600 mm wide×1.8 mm thick) of PD200 available from Asahi Glass Company Ltd. was prepared, and the surfaces thereof were degreased by organic solvent cleaning, pure water rinse, and UV/ozone cleaning. A passive-matrix wiring having 1,080 rows and 5,760 columns was formed on the first substrate, and 500 electron sources of the Spindt type were formed at each intersection of the matrix wiring. The intersections were formed in an area 40 mm inside the four sides of the first substrate 103. Herein, the area is defined as an effective pixel area. The ineffective pixel area of the matrix wiring extended to the edge portion of the first substrate 103. A silicon dioxide ($SiO_2$) film several micrometers thick, serving as an insulating layer, was formed in a portion 20 mm wide inside a peripheral wire lead portion 10 mm wide in the edge portion using a plasma CVD device. Furthermore, titanium films 500 nm thick, serving as non-evaporable getters, were formed on the 1,080 row electrodes corresponding to scanning-signal wiring lines in the matrix wiring lines by DC sputtering.

Furthermore, forty substrates of PD200 available from Asahi Glass Company Ltd. having dimensions of 950 mm long×1.5 mm wide×0.15 mm thick, serving as atmospheric-pressure-resistant and interval-defining members (hereinafter referred to as spacers), were disposed at regular intervals in the effective pixel area.

The spacers were insulating spacer substrates having anti-static films formed thereon.

An exhaust hole (not shown) having a diameter of 10 mm was formed in the ineffective pixel area of the first substrate 103. The position of this area did not interfere with that of the lead portion of the matrix wiring.

Next, in a second step, the frame member 104 and the pushing plate 202 were prepared. The frame member 104 was formed by joining four PD200 glass bodies each having a cross-section of 6 mm wide×1.5 mm height to each other so as to have a frame shape. Furthermore, a PD200 glass plate having the same shape as the first substrate was washed and degreased by the same method as that used for the first substrate 103. This glass plate was used as the pushing plate 202.

Next, in a third step, the second joining member 207 was prepared and the frame member 104 was temporarily mounted on the first substrate 103. First, the second joining member 207 was prepared by patterning a piece of high-purity aluminum foil having a thickness of 10 μm into a frame shape having a width of 4 mm. The purity of the aluminum foil was 99.95 atomic percent (atm. %). Next, the frame member 104 was temporarily mounted on the first substrate 103 prepared in the first step via the second joining member 207. The second joining member 207 was disposed in the center of the area of the $SiO_2$ insulating layer having a frame shape with a width of 6 mm formed on the peripheral portion of the first substrate 103.

Next, the pushing plate 202 was mounted on the frame member 104 temporarily mounted on the first substrate 103. Subsequently, a load is applied to the pushing plate 202 using a clamping jig (not shown).

Figure 7A:
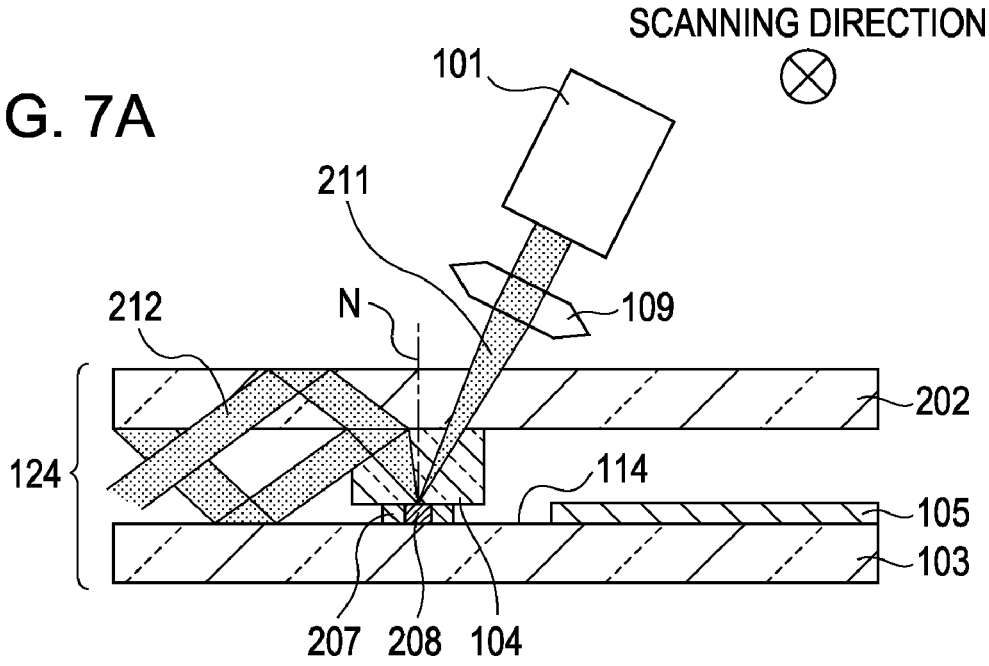
FIGS. 7A and 7B are conceptual views illustrating a method for producing an airtight container according to a second exemplary embodiment of the present invention.
Figure 7B:
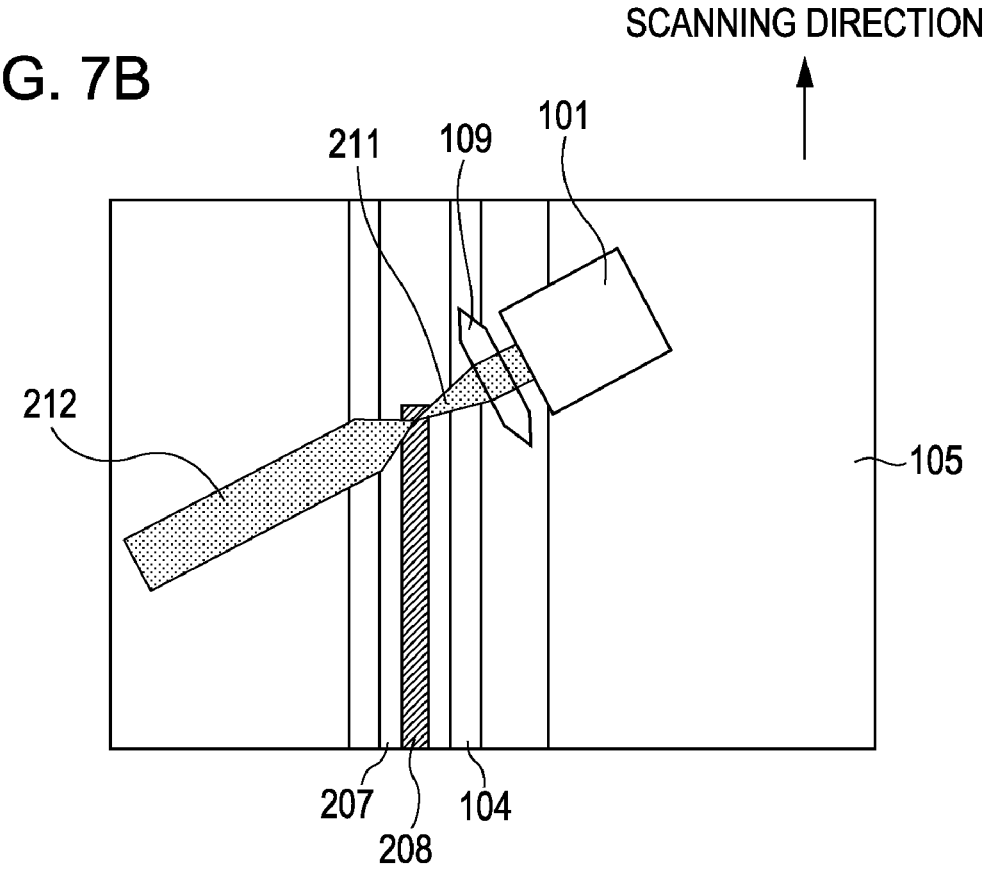
Figure 8:
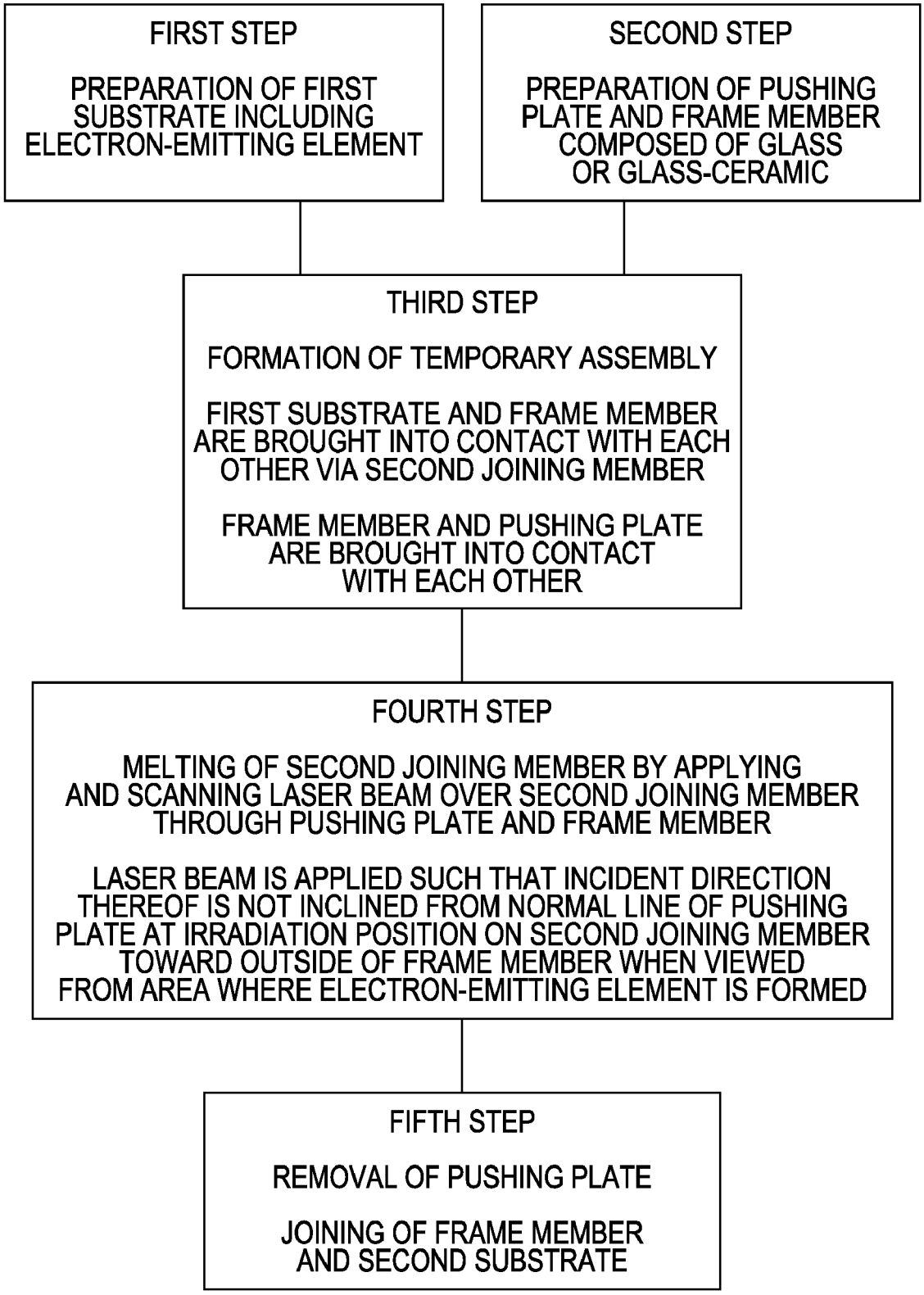
FIG. 8 is a flow chart illustrating the method for producing the airtight container according to the second exemplary embodiment of the present invention.

Next, in a fourth step, the laser source 101 was prepared first as shown in FIG. 7A. The laser source was a semiconductor laser having a wavelength of 808 nm. The profile of the irradiation beam was shaped by combining beam splitters and converging lenses such that the center of gravity and the direction of the major axis of the auxiliary heating beam, having a minor axis of 5 mm and a major axis of 10 mm, and those of the processing beam, having a minor axis of 1 mm and a major axis of 2 mm, overlapped with each other. The operating distance was determined such that this shaped-beam spot was converged on the position of the second joining member 207. The optical axis of the center of gravity of this laser beam was inclined by 30° from the normal line of the first substrate 103, and further inclined such that an angle of 110° was formed between the orthogonal projection of the optical axis and a longitudinal direction of the second joining member 207. The longitudinal direction herein referred to a direction along which a side of the second joining member 207 to be irradiated extended as shown in FIG. 7B. With this state, the laser beam was scanned in the direction parallel to the longitudinal direction of the second joining member, and the second joining area 208 having a width of about 1 mm was circumferentially formed in the center of the second joining member 207 having a width of 4 mm. In this manner, a continuous airtight second joining area was formed. In this manner, an assembly was prepared.

Next, in a fifth step, the pushing force of the clamping jig was released, and the pushing plate 202 was removed. The first joining member 107 composed of the same material and having the same size as the second joining member 207 was mounted on the frame member 104 from which the pushing plate was removed. Furthermore, the second substrate 102 having the phosphor 106 facing the electron-emitting elements 105 on the first substrate 103 was laid on the frame member 104 via the first joining member 107. Next, the first substrate 103 and the second substrate 102 were pushed against each other using a clamping jig (not shown). In this manner, the temporary assembly constituted by the first substrate 103, the airtight second joining area 208, the frame member 104, the first joining member 107, and the second substrate 102 was formed.

Herein, the laser source 101 used in the fourth step was prepared. The laser source was a semiconductor laser having a wavelength of 808 nm. The profile of the irradiation beam was shaped by combining beam splitters and converging lenses such that the center of gravity and the direction of the major axis of the auxiliary heating beam, having a minor axis of 5 mm and a major axis of 10 mm, and those of the processing beam, having a minor axis of 1 mm and a major axis of 2 mm, overlapped with each other. The operating distance was determined such that this shaped-beam spot was converged on the position of the first joining member 107. The optical axis of the center of gravity of this laser beam was inclined by 30° from the normal line of the first substrate 103 of the temporary assembly, and further inclined such that an angle of 110° was formed between the orthogonal projection of the optical axis and the longitudinal direction of the first joining member 107. With this state, the laser beam was scanned in the direction parallel to the longitudinal direction of the first joining member 107, and the first joining area 108 having a width of about 1 mm was circumferentially formed in the center of the first joining member 107 having a width of 4 mm. In this manner, a continuous airtight first joining area was formed.

As described above, an airtight container, constituted by the first substrate 103, the frame member 104, and the second substrate 102, whose four sides were hermetically sealed and bonded was able to be produced by combining the first exemplary embodiment and the second exemplary embodiment.

In order to produce a vacuum-tight container to be applied to a FED, a glass exhaust pipe was connected to an exhaust hole of the airtight container, and an external exhaust system including a scroll pump and a turbo-molecular pump was connected to the exhaust hole via the exhaust pipe so that the airtight container was evacuated. Furthermore, the exhaust pipe and the airtight container were baked for one hour at 350° C. at the same time as the operation of the external exhaust system so that the non-evaporable getters of titanium (NEG-Ti) formed on the first substrate were activated. Subsequently, when the temperature of the airtight container fell to 300° C., the exhaust hole was chipped off and the airtight container was completely sealed.

The FED to which the airtight container produced as above was applied was able to be stably driven for a long period of time. It was confirmed that the produced airtight container exhibited air-tightness with which a high vacuum, high enough to be applied to a FED, was maintained.

Example 2

In this example, an airtight container was produced using the third exemplary embodiment. In Example 1, the first substrate 103 and the frame member 104 were joined to each other using the pushing plate 202 as a dummy substrate. In contrast, the second substrate 102 and the frame member 104 were joined to each other in advance using glass frit in this example, and subsequently, the first substrate 103 and the frame member 104 were joined to each other using the same joining method as in Example 1. In this manner, an airtight container in which the first substrate 103, the frame member 104, and the second substrate 102 were joined to each other was produced.

The FED to which the airtight container produced as above was applied was able to be stably driven for a long period of time. It was confirmed that the produced airtight container exhibited air-tightness with which a high vacuum, high enough to be applied to a FED, was maintained.

Example 3

In this example, an airtight container was produced using the laser optical system arranged as in Example 1 except that the aluminum foil of the second joining member 207 used in the third step in Example 1 was replaced with glass frit (not shown) having a coefficient of linear expansion of $80\times10^{-7}$ per ° C. Herein, the glass frit had a coefficient of linear expansion of $80\times10^{-7}$ per ° C. in the range of room temperature to 400° C., and was applied on the frame member 104 by screen printing.

The FED to which the airtight container produced as above was applied was able to be stably driven for a long period of time. It was confirmed that the produced airtight container exhibited air-tightness with which a high vacuum, high enough to be applied to a FED, was maintained.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-283125 filed Nov. 4, 2008, which is hereby incorporated by reference herein in its entirety.

What is claimed is:

1. A method for producing an airtight container including a first substrate having an electron-emitting element disposed on a first surface thereof, a light-transmitting second substrate facing the first substrate and a frame member interposed between the first substrate and the second substrate, the first substrate, the second substrate, and the frame member forming an inner space in which the electron-emitting element is located, the frame member being capable of transmitting light, the method comprising:

preparing an assembly comprising the first substrate and the frame member mounted on the first surface of the first substrate outside an area where the electron-emitting element is formed, by:

temporarily fixing the frame member to the first substrate by bringing the first substrate into contact with the frame member via a second joining member and pushing the frame member using a light-transmitting pushing plate;

melting the second joining member by irradiating the second joining member with a laser beam transmitted through the pushing plate and the frame member;

solidifying the melted second joining member; and removing the pushing plate;

forming a temporary assembly comprising the assembly and the second substrate by bringing the second substrate into contact with the frame member via a first joining member;

melting the first joining member by irradiating the first joining member with a laser beam transmitted through the second substrate of the temporary assembly; and solidifying the melted first joining member, wherein the laser beam is applied onto the first joining member such that an incident direction of the laser beam at an irradiation position on the first joining member does not include components toward the interior of the frame member while the laser beam moves relative to the temporary assembly during melting of the first joining member, and the laser beam is applied onto the second joining member such that an incident direction of the laser beam at an irradiation position on the second joining member does not include components toward the interior of the frame member while the laser beam moves relative to the first substrate during melting of the second joining member.

2. The method according to claim 1, wherein the laser beam is applied onto the first joining member obliquely to a normal line of the second substrate during melting of the first joining member.

3. The method according to claim 1, wherein the laser beam is applied onto the second joining member obliquely to a normal line of the pushing plate during melting of the second joining member.

4. The method according to claim 1, wherein the electron-emitting element is a cold-cathode electron source.

5. The method according to claim 4, wherein an electron-emitting portion of the cold-cathode electron source contains graphite.

6. The method according to claim 1, wherein the first joining member is composed of metal.

7. A method for producing an airtight container including a first substrate having an electron-emitting element disposed on a first surface thereof, a light-transmitting second substrate facing the first substrate, and a light-transmitting frame member interposed between the first substrate and the second substrate, the first substrate, the second substrate, and the frame member forming an inner space in which the electron-emitting element is located, the method comprising:

preparing an assembly comprising the second substrate and the frame member by mounting the frame member on the second substrate;

forming a temporary assembly comprising the assembly and the first substrate by bringing the frame member into contact with the first surface of the first substrate outside an area where the electron-emitting element is formed via a first joining member;

melting the first joining member by irradiating the first joining member with a laser beam transmitted through the second substrate and the frame member of the temporary assembly; and solidifying the melted first joining member, wherein the laser beam is applied onto the first joining member such that an incident direction of the laser beam at an irradiation position on the first joining member does not include components toward the interior of the frame member while the laser beam moves relative to the temporary assembly during melting of the first joining member.

8. The method according to claim 7, wherein the laser beam is applied onto the first joining member obliquely to a normal line of the first substrate during melting of the first joining member.

* * * * *